US010669663B2

(12) United States Patent
Borlin et al.

(10) Patent No.: US 10,669,663 B2
(45) Date of Patent: Jun. 2, 2020

(54) LAUNDRY TREATING APPLIANCE AND METHODS OF OPERATION

(71) Applicant: WHIRLPOOL CORPORATION, Benton Harbor, MI (US)

(72) Inventors: Christopher L. Borlin, Saint Joseph, MI (US); Brian P. Janke, Saint Joseph, MI (US); Joseph M. Keres, Stevensville, MI (US); Stephen L. Keres, Stevensville, MI (US); Guilherme Bencke Teixeira Da Silva, Joinville (BR); Adrian A. Rodriguez, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/298,116

(22) Filed: Mar. 11, 2019

(65) Prior Publication Data

US 2019/0203398 A1 Jul. 4, 2019

Related U.S. Application Data

(62) Division of application No. 14/872,575, filed on Oct. 1, 2015, now Pat. No. 10,273,621.

(51) Int. Cl.

| | |
|---|---|
| ***D06F 37/20*** | (2006.01) |
| ***D06F 35/00*** | (2006.01) |
| ***D06F 37/24*** | (2006.01) |
| ***D06F 23/04*** | (2006.01) |
| *D06F 33/02* | (2006.01) |
| *D06F 37/22* | (2006.01) |

(52) U.S. Cl.

CPC ..... *D06F 37/203* (2013.01); *D06F 23/04* (2013.01); *D06F 35/005* (2013.01); *D06F 37/24* (2013.01); *D06F 33/02* (2013.01); *D06F 37/225* (2013.01); *D06F 2202/06* (2013.01); *D06F 2202/12* (2013.01); *D06F 2222/00* (2013.01)

(58) Field of Classification Search

CPC ..... D06F 37/203

See application file for complete search history.

(56) References Cited

U.S. PATENT DOCUMENTS

| | | | |
|---|---|---|---|
| 4,782,544 | A | 11/1988 | Nystuen et al. |
| 5,293,760 | A | 3/1994 | Tani et al. |
| 5,692,313 | A | 12/1997 | Ikeda et al. |

(Continued)

FOREIGN PATENT DOCUMENTS

| | | | |
|---|---|---|---|
| CA | 2411700 | A1 | 6/2003 |
| DE | 19802650 | A1 | 7/1999 |

(Continued)

*Primary Examiner* — Michael E Barr
*Assistant Examiner* — Jason P Riggleman
(74) *Attorney, Agent, or Firm* — McGarry Bair PC

(57) ABSTRACT

Methods of reducing a likelihood of contact between a rotating laundry-container, such as a basket or drum, located within a tub of a laundry treating appliance where the method includes rotating the drum during a measurement period, determining a torque, speed, acceleration, and position of the drum, using a parameter estimator to estimate the position of a mass relative to an imbalance of laundry and accelerating the rotation of the drum when the mass is determined to be angularly spaced from the relative position of the imbalance of laundry.

13 Claims, 6 Drawing Sheets

(56) References Cited

U.S. PATENT DOCUMENTS

| | | | |
|---|---|---|---|
| 5,765,402 | A | 6/1998 | Ikeda et al. |
| 5,893,280 | A | 4/1999 | Honda et al. |
| 5,905,648 | A | 5/1999 | Badami |
| 6,393,918 | B2 | 5/2002 | French et al. |
| 6,505,369 | B1 | 1/2003 | Weinmann |
| 6,633,149 | B1 | 10/2003 | Foureys |
| 7,162,759 | B2 | 1/2007 | Weinmann |
| 7,296,445 | B2 | 11/2007 | Zhang et al. |
| 7,380,303 | B2 | 6/2008 | Bellinetto et al. |
| 7,591,038 | B2 | 9/2009 | Murray et al. |
| 7,905,122 | B2 | 3/2011 | Murray et al. |
| 7,958,585 | B2 | 6/2011 | Zhang et al. |
| 8,122,549 | B2 | 2/2012 | Park et al. |
| 8,186,227 | B2 | 5/2012 | Ashrafzadeh |
| 8,250,690 | B2 | 8/2012 | Jurmann et al. |
| 8,312,581 | B2 | 11/2012 | Pelczer |
| 8,489,358 | B2 | 7/2013 | Petronilho et al. |
| 8,819,880 | B2 | 9/2014 | Ashrafzadeh et al. |
| 8,875,332 | B2 | 11/2014 | Janke et al. |
| 8,910,335 | B2 | 12/2014 | Kim et al. |
| 8,943,629 | B2 | 2/2015 | Paul et al. |
| 8,984,693 | B2 | 3/2015 | Ashrafzadeh et al. |
| 9,010,159 | B2 | 4/2015 | Sharp |
| 9,080,277 | B2 | 7/2015 | Erickson et al. |
| 9,091,011 | B2 | 7/2015 | Janke et al. |
| 9,091,012 | B2 | 7/2015 | Ashrafzadeh et al. |
| 9,096,964 | B2 | 8/2015 | Albayrak et al. |
| 2003/0115682 | A1 | 6/2003 | Gardner |
| 2006/0242768 | A1 | 11/2006 | Zhang et al. |
| 2008/0041115 | A1 | 2/2008 | Kanazawa et al. |
| 2008/0041116 | A1 | 2/2008 | Kanazawa et al. |
| 2008/0178398 | A1 | 7/2008 | Darby et al. |
| 2009/0106913 | A1 | 4/2009 | Suel, II et al. |
| 2009/0308110 | A1 | 12/2009 | Koo et al. |
| 2011/0067185 | A1 | 3/2011 | Koo et al. |
| 2012/0144599 | A1 | 6/2012 | Polli et al. |
| 2012/0151686 | A1 | 6/2012 | Jang et al. |
| 2012/0151693 | A1 | 6/2012 | Jang et al. |
| 2012/0151694 | A1 | 6/2012 | Jang et al. |
| 2012/0246835 | A1 | 10/2012 | Ashrafzadeh et al. |
| 2013/0000054 | A1 | 1/2013 | Zasowski |
| 2013/0031939 | A1 | 2/2013 | Hasanreisoglu et al. |
| 2013/0047344 | A1 | 2/2013 | Janke et al. |
| 2013/0140498 | A1 | 6/2013 | Erickson et al. |
| 2013/0152311 | A1 | 6/2013 | Janke et al. |
| 2013/0152312 | A1 | 6/2013 | Janke et al. |
| 2013/0160220 | A1 | 6/2013 | Ashrafzadeh et al. |
| 2013/0160221 | A1 | 6/2013 | Ashrafzadeh et al. |
| 2014/0013518 | A1 | 1/2014 | Janke et al. |
| 2014/0215725 | A1 | 8/2014 | Paglia et al. |
| 2014/0318246 | A1 | 10/2014 | Miyaji |
| 2014/0379142 | A1* | 12/2014 | Borlin ..... D06F 35/007 700/279 |
| 2015/0047396 | A1 | 2/2015 | Beckert Polli et al. |
| 2015/0101668 | A1 | 4/2015 | Janke et al. |

FOREIGN PATENT DOCUMENTS

| | | | |
|---|---|---|---|
| DE | 102012223611 | A1 | 6/2014 |
| DE | 102014109650 | A1 | 2/2015 |
| EP | 0433157 | A1 | 6/1991 |
| EP | 0494667 | A1 | 7/1992 |
| EP | 0704568 | B1 | 12/1998 |
| EP | 0921226 | A2 | 6/1999 |
| EP | 1350881 | A1 | 10/2003 |
| EP | 1734167 | A1 | 12/2006 |
| EP | 2607536 | A1 | 6/2013 |
| EP | 2765230 | A1 | 8/2014 |
| JP | 05277289 | A | 10/1993 |
| WO | 2004097099 | A1 | 11/2004 |

* cited by examiner

LAUNDRY TREATING APPLIANCE AND METHODS OF OPERATION

CROSS-REFERENCE TO RELATED APPLICATION(S)

This application is a divisional of U.S. patent application Ser. No. 14/872,575, filed Oct. 1, 2015, now U.S. Pat. No. 10,273,621, issued Apr. 30, 2019, which is incorporated herein by reference in its entirety.

BACKGROUND

Laundry treating appliances, such as washing machines, refreshers, and non-aqueous systems, can have a configuration based on a rotating container that defines a treating chamber in which laundry items are placed for treating. In a vertical axis washing machine, the container is in the form of a perforated basket located within a tub; both the basket and tub typically have an upper opening at their respective upper ends. In a horizontal axis washing machine, the container is in the form of a perforated drum located within a tub; both the drum and tub typically have an opening at their respective front facing ends. The laundry treating appliance can have a controller that implements the cycles of operation having one or more operating parameters. The controller can control a motor to rotate the container according to one of the cycles of operation. When laundry is loaded within the container, the rotation of the container via the motor can cause contact between the container and the tub due to an imbalance in the laundry load.

BRIEF SUMMARY

In one aspect, a method of operating a laundry treating appliance having a drum at least partially defining a treating chamber for receiving a laundry load for treatment according to a cycle of operation, a motor operably coupled with the drum to rotate the drum, and at least one balance ring mounted to the drum and defining an internal annular cavity in which a mass is located, the method comprising: rotating the drum during a measurement period;

determining, during the measurement period, by a controller communicably coupled with the motor, at least one of a torque of the motor, an acceleration of the drum, a speed of the drum, and an angular position of the drum; repeatedly estimating with a parameter estimator, during the measurement period, a relative position of an imbalance of a laundry load and a relative position of the mass, based on at least one of the torque, acceleration, speed, and angular position of the drum; and accelerating the rotating of the drum during the cycle of operation when the relative position of the mass is determined to be angularly spaced from the relative position of the imbalance of the laundry load.

In another aspect, a method of operating a laundry treating appliance having a drum at least partially defining a treating chamber for receiving a laundry load for treatment according to a cycle of operation, a motor operably coupled with the drum to rotate the drum, and at least one balance ring mounted to the drum and defining an internal annular cavity in which a mass is located, the method comprising: using a parameter estimator programmed in a processor of the laundry treating appliance to repeatedly estimate a relative position of the mass and a relative position of the laundry load based upon at least one of the torque, acceleration, speed, and angular position of the drum as the drum rotates; and accelerating the rotational speed of the drum during the cycle of operation when the relative position of the mass is determined to be angularly spaced from the relative position of the laundry load.

DETAILED DESCRIPTION

Embodiments of the invention relates to reducing a likelihood of a container-tub contact during suspension critical speeds or frequencies, such as 100-250 revolutions per minute (rpm) of a laundry treating appliance caused by a load imbalance during the rotational acceleration of the drum, commonly known as and referred to hereinafter as 'ramping.' Existing solutions in a horizontal axis washing machine include the use of balance balls disposed within a balance ring to counteract a load imbalance in order to prevent container-tub contact due to an imbalance. Such balance rings automatically balance a load imbalance when the drum speed is above the suspension critical speeds. However, such existing balance rings can add to the load imbalance when the balance masses within the ring is positioned in phase with, or adjacent to, the load imbalance, particularly during low speed drum rotation, such as 50-150 rpm, preferably at 90 rpm. It should be understood that a low speed rotation can be relative to the lag of the balance masses rotating relative to the drum. Additional factors such as viscosity of the fluid or radius of a balance ring can affect the lag of the balance masses relative to the rotation of the drum, further defining a low speed based upon the relative lag.

Furthermore, when ramping from a low speed drum rotation to a high speed drum rotation, such as 300 rpm or greater, the load imbalance in combination with the mass of the balance balls can increase the total imbalance during the rotational acceleration of the drum, causing forceful contact during the ramping period. Existing balance ring solutions do not account for the increased imbalance due to the balance balls moving in phase with the load imbalance at low speeds or during ramping. It should be understood that the high speed rotation can also vary relative to the lag of the balance masses, such that the balance masses are not lagging behind the rotation of the drum.

As described herein, the term "imbalance," when used alone or in combination with the words "condition", "mass", "phase", "magnitude", "position," or otherwise, refers to an object being in the state of unbalance relative to its respective reference frame.

Figure 1:
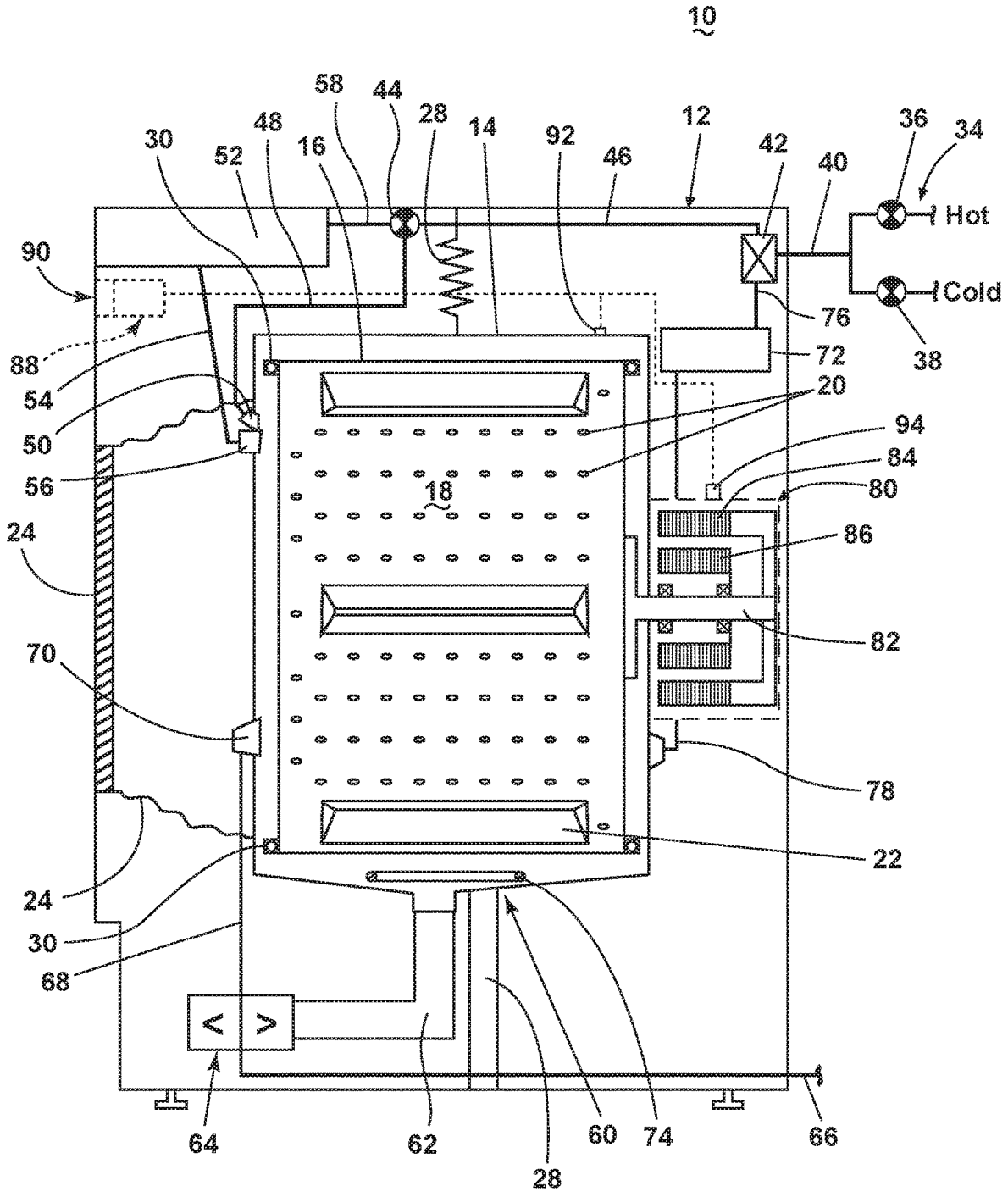
FIG. 1 is a schematic view of a laundry treating appliance in the form of a horizontal washing machine.

Embodiments of the invention can be utilized with a laundry treating appliance in the form of a horizontal-axis washing machine 10 as illustrated in FIG. 1. The horizontal-axis washing machine 10 is exemplary, and use with a laundry treating appliance varying from a horizontal-axis relative to a surface upon which it rests is contemplated. More specifically, the horizontal-axis washing machine 10 can be operated, according to an embodiment of the invention, to reduce the likelihood of contact between a rotating laundry-container and a tub or between the tub and a container. A structural support system including a cabinet 12 can define a housing within which a laundry holding system resides. The cabinet 12 can be a housing having a chassis and/or a frame, defining an interior, enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a rotatable laundry-container in the form of a drum 16 provided within the tub 14. The drum 16 defines at least a portion of a laundry treating chamber 18 for receiving a laundry load for treatment. The drum 16 can include a plurality of perforations 20 such that liquid can flow between the tub 14 and the drum 16 through the perforations 20. A plurality of baffles 22 can be disposed on an inner surface of the drum 16 to lift the laundry load received in the treating chamber 18 while the drum 16 rotates. It can also be within the scope of the invention for the laundry holding system to include only a tub with the tub defining the laundry treating chamber.

The laundry holding system can further include a door 24 which can be movably mounted to the cabinet 12 to selectively close both the tub 14 and the drum 16. A bellows 26 can couple an open face of the tub 14 with the cabinet 12, with the door 24 sealing against the bellows 26 when the door 24 closes the tub 14. The washing machine 10 can further include a suspension system 28 for dynamically suspending the laundry holding system within the structural support system.

The washing machine 10 can also include at least one balance ring 30 containing a balancing material moveable within the balance ring 30 to counterbalance an imbalance that can be caused by a load of laundry in the treating chamber 18 during rotation of the drum 16. More specifically, the balance ring 30 can be coupled with the rotating drum 16 and configured to compensate for a dynamic imbalance during rotation of the rotatable drum 16. The balance ring 30 can extend circumferentially around a periphery of the drum 16 and can be located at any desired location along an axis of rotation of the drum 16. While one balance ring 30 is shown mounted to the front end of the drum 16, multiple balance rings 30 are contemplated. When multiple balance rings 30 are present, they can be equally spaced along the axis of rotation of the drum 16. For example, if two balance rings 30 are utilized, they can be operably coupled with opposite ends of the rotatable drum 16.

The washing machine 10 can further include a liquid supply system for supplying water to the washing machine 10 for use in treating laundry during a cycle of operation. The liquid supply system can include a source of water, such as a household water supply 34, which can include separate valves 36 and 38 for controlling the flow of hot and cold water, respectively. Water can be supplied through an inlet conduit 40 directly to the tub 14 by controlling first and second diverter mechanisms 42 and 44, respectively. The diverter mechanisms 42, 44 can be a diverter valve having two outlets such that the diverter mechanisms 42, 44 and can selectively direct a flow of liquid to one or both of two flow paths. Water from the household water supply 34 can flow through the inlet conduit 40 to the first diverter mechanism 42 which can direct the flow of liquid to a supply conduit 46. The second diverter mechanism 44 on the supply conduit 46 can direct the flow of liquid to a tub outlet conduit 48 which can be provided with a spray nozzle 50 configured to spray the flow of liquid into the tub 14. In this manner, water from the household water supply 34 can be supplied directly to the tub 14.

The washing machine 10 can also be provided with a dispensing system for dispensing treating chemistry to the treating chamber 18 for use in treating the laundry according to a cycle of operation. The dispensing system can include a dispenser 52 which can be a single use dispenser, a bulk dispenser or a combination of a single use and bulk dispenser.

Regardless of the type of dispenser used, the dispenser 52 can be configured to dispense a treating chemistry directly to the tub 14 or mixed with water from the liquid supply system through a dispensing outlet conduit 54. The dispensing outlet conduit 54 can include a dispensing nozzle 56 configured to dispense the treating chemistry into the tub 14 in a desired pattern and under a desired amount of pressure. For example, the dispensing nozzle 56 can be configured to dispense a flow or stream of treating chemistry into the tub 14 by gravity, i.e. a non-pressurized stream. Water can be supplied to the dispenser 52 from the supply conduit 46 by directing the diverter mechanism 44 to direct the flow of water to a dispensing supply conduit 58.

Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 can also include a recirculation and drain system for recirculating liquid within the laundry holding system and draining liquid from the washing machine 10. Liquid supplied to the tub 14 through tub outlet conduit 48 and/or the dispensing supply conduit 58 typically enters a space between the tub 14 and the drum 16 and can flow by gravity to a sump 60 formed in part by a lower portion of the tub 14. The sump 60 can also be formed by a sump conduit 62 that can fluidly couple the lower portion of the tub 14 to a pump 64. The pump 64 can direct liquid to a drain conduit 66, which can drain the liquid from the washing machine 10, or to a recirculation conduit 68, which can terminate at a recirculation inlet 70. The recirculation inlet 70 can direct the liquid from the recirculation conduit 68 into the drum 16. The recirculation inlet 70 can introduce the liquid into the drum 16 in any suitable manner, such as by spraying, dripping, or providing a steady flow of liquid. In this manner, liquid provided to the tub 14, with or without treating chemistry can be recirculated into the treating chamber 18 for treating the laundry within.

The liquid supply and/or recirculation and drain system can be provided with a heating system which can include one or more devices for heating laundry and/or liquid supplied to the tub 14, such as a steam generator 72 and/or a sump heater 74. Liquid from the household water supply 34 can be provided to the steam generator 72 through the inlet conduit 40 by controlling the first diverter mechanism 42 to direct the flow of liquid to a steam supply conduit 76. Steam generated by the steam generator 72 can be supplied to the tub 14 through a steam outlet conduit 78. The steam generator 72 can be any suitable type of steam generator such as a flow through steam generator or a tank-type steam generator. Alternatively, the sump heater 74 can be used to generate steam in place of or in addition to the steam generator 72. In addition or alternatively to generating steam, the steam generator 72 and/or sump heater 74 can be used to heat the laundry and/or liquid within the tub 14 as part of a cycle of operation.

Additionally, the liquid supply and recirculation and drain system can differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system can include a motor 80 for rotationally driving the drum 16. The motor 80 can be directly coupled with the drum 16 through a drive shaft 82 to rotate the drum 16 about a rotational axis during a cycle of operation. The motor 80 can be a brushless permanent magnet (BPM) motor having a stator 84 and a rotor 86. Alternately, the motor 80 can be coupled with the drum 16 through a belt and a drive shaft to rotate the drum 16, as is known in the art. Other motors, such as an induction motor or a permanent split capacitor (PSC) motor, can also be used. The motor 80 can rotationally drive the drum 16 including that the motor 80 can rotate the drum 16 at various speeds in either rotational direction. The motor 80 can be configured to rotatably drive the drum 16 in response to a motor control signal.

The washing machine 10 also includes a control system for controlling the operation of the washing machine 10 to implement one or more cycles of operation. The control system can include a controller 88 located within the cabinet 12 and a user interface 90 that is operably coupled with the controller 88. The user interface 90 can include one or more knobs, dials, switches, displays, touch screens, and the like for communicating with the user, such as to receive input and provide output. The user can enter different types of information including, without limitation, cycle selection and cycle parameters, such as cycle options.

The controller 88 can include the machine controller and any additional controllers provided for controlling any of the components of the washing machine 10. For example, the controller 88 can include the machine controller and a motor controller. Many known types of controllers can be used for the controller 88. It is contemplated that the controller can be a microprocessor-based controller that implements control software and sends/receives one or more electrical signals to/from each of the various working components to effect the control software.

The controller 88 can also be coupled with one or more sensors 92, 94 provided in one or more of the systems of the washing machine 10 to receive input from the sensors, which are known in the art and not shown for simplicity. Non-limiting examples of sensors 92, 94 that can be communicably coupled with the controller 88 include: a treating chamber temperature sensor, a moisture sensor, a weight sensor, a chemical sensor, a position sensor, an acceleration sensor, a speed sensor, an orientation sensor, an imbalance sensor, a load size sensor, and a motor torque sensor, which can be used to determine a variety of system and laundry characteristics, such as laundry load inertia or mass and system imbalance magnitude and position.

For example, a motor torque sensor, a speed sensor, an acceleration sensor, and/or a position sensor can also be included in the washing machine 10 and can provide an output or signal indicative of the torque applied by the motor, a speed of the drum 16 or component of the drive system, an acceleration of the drum 16 or component of the drive system, and a position sensor of the drum 16. Such sensors 92, 94 can be any suitable types of sensors including, but not limited to, that one or more of the sensors 92, 94 can be a physical sensor or can be integrated with the motor and combined with the capability of the controller 88 to function as a sensor. For example, motor characteristics, such as speed, current, voltage, torque etc., can be processed such that the data provides information in the same manner as a separate physical sensor. In contemporary motors, the motors often have their own controller that outputs data for such information.

Figure 2:
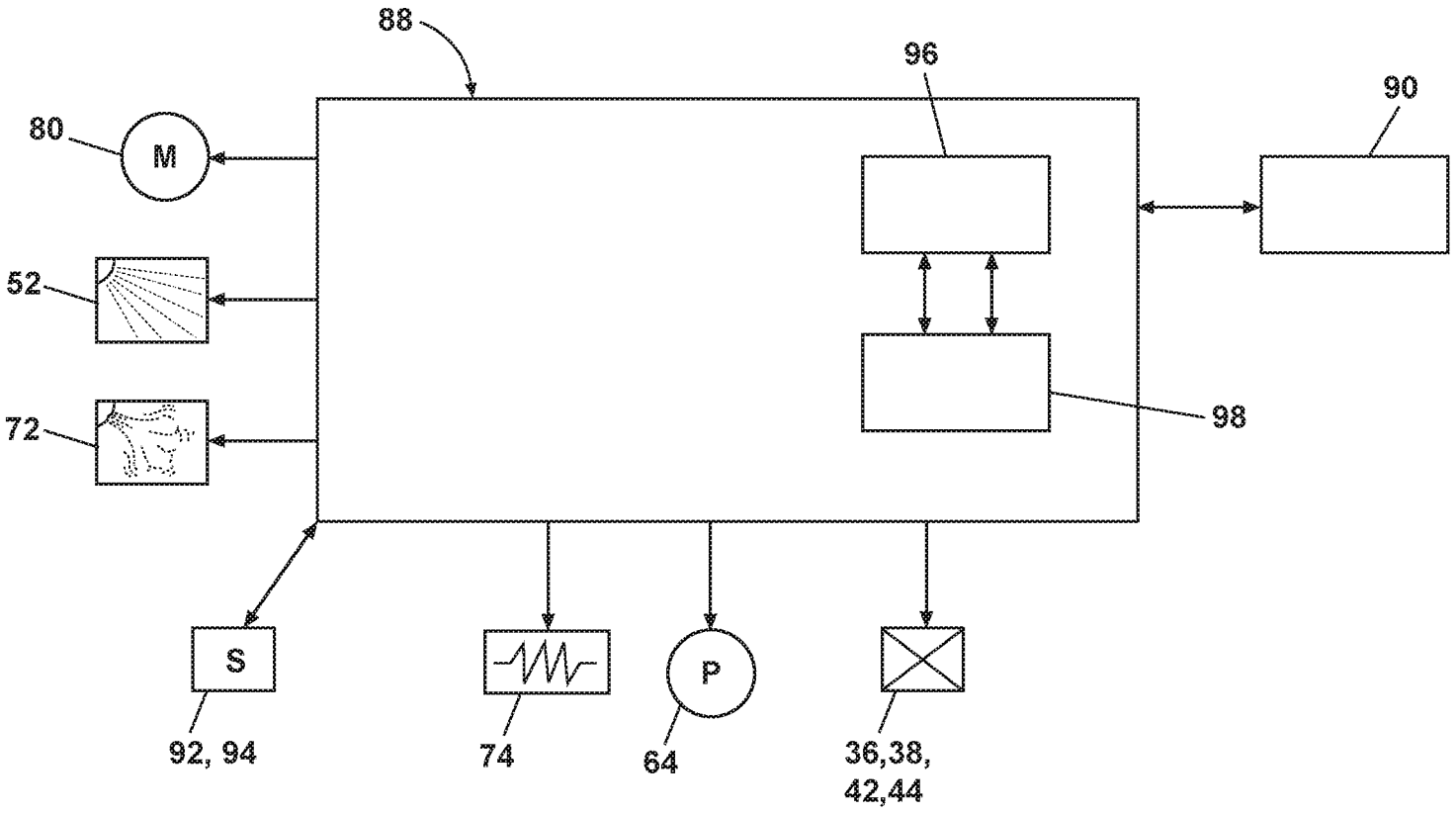
FIG. 2 is a schematic of a control system for the laundry treating appliance of FIG. 1.

As illustrated in FIG. 2, the controller 88 can be provided with a memory 96 and a central processing unit (CPU) 98. The memory 96 can be used for storing the control software that can be executed by the CPU 98 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 96 can also be used to store information, such as a database or table, and to store data received from one or more components or sensors 92, 94 of the washing machine 10 that can be communicably coupled with the controller 88. The database or table can be used to store the various operating parameters for the one or more cycles of operation, including factory default values for the operating parameters and any adjustments to them by the control system or by user input. Such operating parameters and information stored in the memory 96 can include, but are not limited to, acceleration ramps, threshold values, predetermined criteria, etc.

The controller 88 can be operably coupled with one or more components of the washing machine 10 for communicating with and controlling the operation of the component to complete a cycle of operation. For example, the controller 88 can be operably coupled with the motor 80, the pump 64, the dispenser 52, the steam generator 72 and the sump heater 74 to control the operation of these and other components to implement one or more of the cycles of operation.

During operation of the washing machine 10, an imbalance of the laundry load or mass within the balance ring can flex the drum 16 and the drive shaft, allowing the container to contact, e.g., rub, against the tub 14. Such excessive imbalances can cause failure in the drive unit components and other structural components in the system. This can result in a loud noise, tub damage over time, expulsion of treating liquid from the tub, etc.

Figure 3:
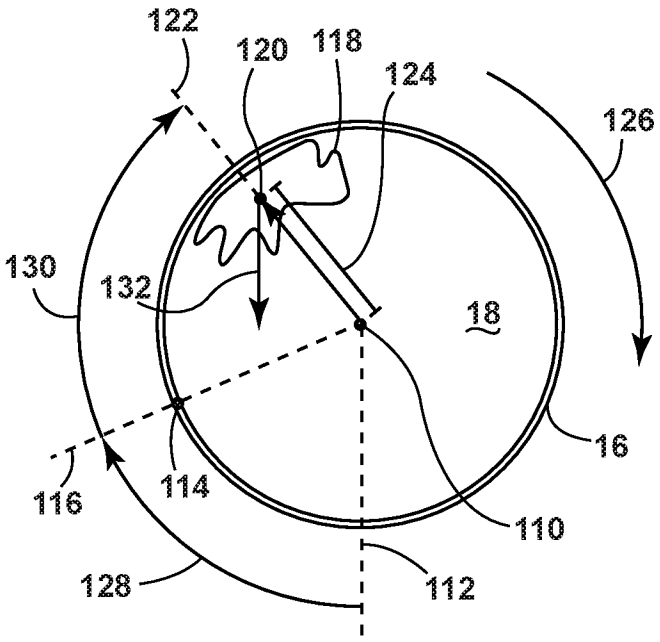
FIG. 3 is a schematic view of the imbalance of a laundry load within the drum of the washing machine of FIG. 1.

The previously described washing machine 10 can be used to implement one or more embodiments of a method of the invention. Referring now to FIG. 3, the drum 16 defines a longitudinal axis shown as a center point 110 from the front view illustrated in the figure. For the horizontal washing machine, a vertical axis 112 extends through the center point 110 and is disposed normal to the longitudinal axis of the drum 16. Thus, the vertical axis 112 intersects the drum 16 at the bottom of the drum 16 relative to an outside observer. A fixed point 114 on the drum 16, which can be utilized as a reference point to determine a rotational position of the drum, can further define a fixed axis 116 extending from the center point 110 through the fixed point 114.

The laundry load disposed within the drum 16 during spinning operation of the washing machine 10 can be imbalanced relative to the total mass of laundry spread over the surface of the drum 16, defining a load mass 118 representative of the mass of the imbalance of laundry. It should be appreciated that the load mass 118 may not represent the entire volume of laundry within the laundry treating chamber, but can represent a portion or partial volume of the laundry representing a higher mass relative to the rest of the laundry within the treating chamber. During rotation, the load mass 118 can become stuck to the side of the drum 16 operating at a particular rotational frequency, causing the imbalance in the laundry load and thus an imbalance in the drum 16. A center of mass 120 for the load mass 118 can further define a load axis 122 extending from the center point 110 through the center of mass 120. A load mass radius 124 can also be determined as the distance from the center point 110 to the center of mass 120.

The drum 16 is rotated during a cycle of operation in a direction of rotation 126. As such, a rotational position 128 of the drum 16 can be determined as the arcuate angle from the vertical axis 112 to the reference axis 116. In exemplary embodiments, sensors such as a laser sensor, motor torque sensor, motor speed sensor, or position sensor can be used to determine the position of the fixed point 114 in order to determine a position of the drum 16 relative to the vertical axis 112 as the rotational position 128 of the drum 16. Thus, as the drum 16 rotates during a cycle of operation, the rotational position 128 of the drum 16 can constantly be changing from 0° to 359°, continuously, relative to the vertical axis 112 in the direction of rotation 126. Additionally, an imbalance phase angle 130 of the load mass 118 can be calculated based upon the arcuate angle between the fixed axis 116 and the load axis 122. During rotation of the drum 16, as an imbalance condition occurs, the load mass 118 can become stuck to the sidewall of the drum 16, as is common with laundry treating appliances. As such, the load mass 118 can rotate in unison with the drum 16, thus, the value for the imbalance phase angle 130 remains constant during the imbalance condition. Furthermore, gravitational acceleration comprising a gravitational vector 132 acts on the load mass 118 as it spins within the drum 16.

Figure 4:
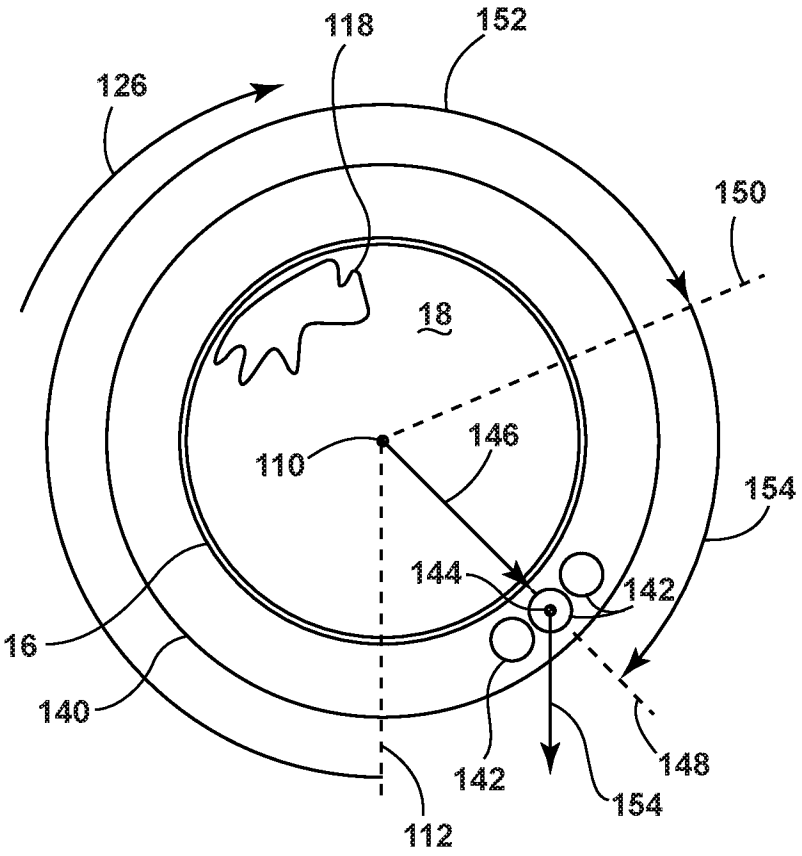
FIG. 4 is a schematic view of the imbalance of a plurality of balance balls within the drum of the washing machine of FIG. 1.

Turning now to FIG. 4, an annular balance ring 140 mounts to the drum 16 and contains a plurality of balancing masses, exemplarily shown as three balancing balls 142. The balancing balls 142 can rotate within the balance ring 140 during rotation of the drum 16. The balancing balls 142 further define a center of mass 144, such that a ball radius 146 is defined from the center point 110 to the center of mass 144 of the balancing balls 142. Additionally, a ball axis 148 can be defined along the ball radius 146.

The position of the center of mass 144 of the balancing balls 142 can be determined relative to the position of the drum 16 utilizing a reference axis 150. The reference axis 150 can be determined relative to the fixed axis 112 of the drum 16 as an arcuate angle 152 from the vertical axis 112. The position 152 of the axis 150 can be measure by a sensor, or generated by a controller that contains a mathematical model of the balancing balls 142. A balance ball phase angle 154 can be determined as the arcuate angle between the reference axis 150 and the ball axis 148.

During operation of the washing machine 10, the controller 88 can be configured to output a motor control signal to the motor 80 to rotate the drum 16. When the drum 16 with the laundry load mass 118 rotates during a cycle of operation, the load mass 118 within the interior of the drum 16 is a part of the inertia of the rotating system of the drum 16, along with other rotating components of the laundry treating appliance. By utilizing a parameter estimator, such as by estimation or calculation, the motor torque, acceleration of the drum 16, speed of the drum 16, and angular position of the drum 16, can be used to determine several parameters, including inertia, mechanical and viscous frictional forces, magnitude of a load imbalance, and position of a load imbalance relative to the position of the drum 16. Sensors disposed within the laundry treating appliance can be utilized to determine motor torque, acceleration, speed, and position of the drum. Exemplary sensors include a motor torque sensor for determining torque and laser sensors to determine acceleration, speed, and position of the drum 16. Furthermore, the rotational position of the drum 128 can be utilized to determine the position of the reference axis 150, the magnitude of the balance ball imbalance, and the position of the balance balls. Generally the relationship between motor torque for rotating the drum 16 and parameters relevant to an off-balance laundry load can be represented in the following equation:

$$T=J\dot{\omega}+b\omega+c+mgr\sin(\alpha+\beta)+m_{BB}gr_{BB}\sin(\alpha_{BB}+\beta_{BB}), \quad (1)$$

where, T=torque, J=inertia, $\dot{\omega}$=acceleration, ω=rotational speed, b=viscous friction, c=coulomb friction, m=mass of the laundry load imbalance, g=gravitational acceleration, r=radius from the axial center of the drum 16 to the center of mass of the laundry load imbalance, α=rotational position of the drum, β=rotational position of the load imbalance mass 118 relative to the rotational position of the drum, $m_{BB}$=mass of the center of mass of the balance balls, $r_{BB}$=radius from the center point of the drum 16 to the center of mass of the balance balls, $\alpha_{BB}$=rotational position reference for the balance balls relative to a fixed axis 112, and $\beta_{BB}$=rotational position of the center of mass of the balance balls relative to the rotational reference position $\alpha_{BB}$. The parameter $\alpha_{BB}$ can be expressed as a tunable function of a such as $\alpha_{BB}=\alpha\cdot(0.97)$, for example, where the factor 0.97 can be tuned based upon exemplary conditions of the washing machine 10 such as the temperature, rotational speed, or balance ring physical characteristics. As such, α can be used determine to $\alpha_{BB}$ by utilizing sensors or a mathematical model operating within a controller.

Additionally, (α+β), where α is the rotational position 128, plus β, which is the imbalance phase angle 130, represents the rotational position of the load mass 118. $(\alpha_{BB}+\beta_{BB})$, where $\alpha_{BB}$ is the reference angle 152, plus $\beta_{BB}$, which is the ball balancer phase angle 154, represents the rotational position of the balance balls 142.

Furthermore, mgr can represent the magnitude of the moment generated by the imbalance of the load mass 118 about an axis through the center point 110 as determined by the mass, the radius of the load mass 118 from the center point 110, and the gravitational acceleration acting on the load mass 118. Similarly, $m_{BB}gr_{BB}$ can represent the magnitude of the momentum generated by the imbalance of the balance balls 142 about an axis through the center point 110.

Utilizing a parameter estimator, multiple sensor measurements for the torque, acceleration, speed, and position of the drum 16 be used to determine the position and magnitude of the load mass 118 and the position and magnitude of the balance balls 142. The mathematical model of the washing machine 10, namely equation (1), is used to describe the relationship between the magnitudes, position of the load mass 118 and the balancing balls 142, and the torque, acceleration, speed and position. Further still, estimated electrical signals or motor signals can also be utilized as inputs including but not limited to, currents, voltages, etc. The characteristics of the inertia, the mechanical and viscous friction, and magnitudes and positions of the load mass 118 and the balance balls 142 can all be estimated parameters. Any suitable methodology or algorithm, proprietary or known, such as a recursive least squares algorithm can be used to estimate the parameters in such a model.

Thus, during operation, the controller 88, utilizing parameter estimation, can monitor over time a torque signal, a speed signal, an acceleration signal, and a position signal during the rotation of the drum 16. The controller 88 can also repeatedly determine or estimate the position and magnitude of the load mass 118 and the balance balls 142, which can be done continuously or periodically. Such magnitude and position can be repeatedly determined and from the monitored values.

Figure 5:
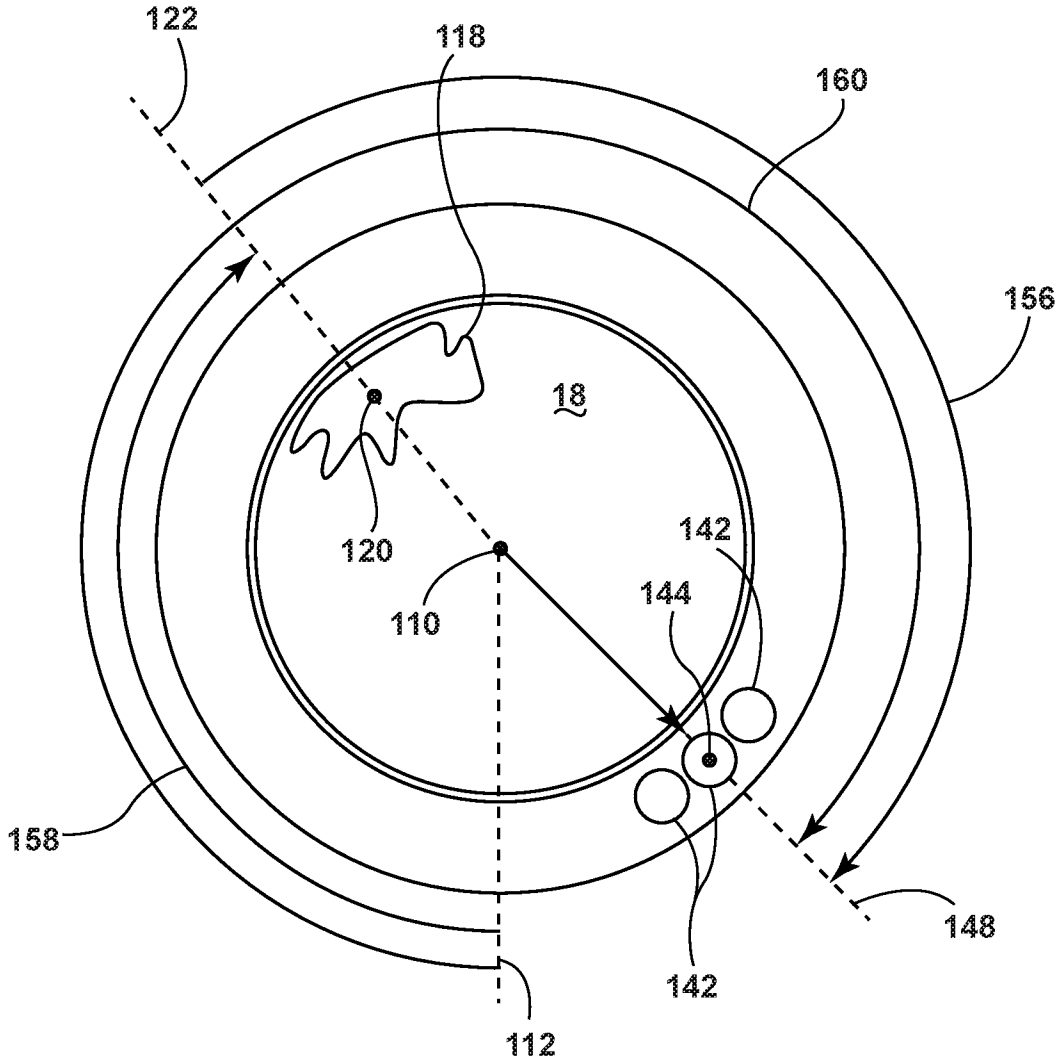
FIG. 5 is a schematic view illustrating the phase difference between the position of the laundry load and the balance balls.

The controller 88 can estimate current or predicted position and magnitude of load mass 118 and the balancing balls 142 in order to determine when the two are in or out of phase. Turning now to FIG. 5, the balance balls and the load mass 118 can be angularly spaced from one another, defined as a mass phase difference 156. The mass phase difference 156 can be determined by the phase difference between the position of the load mass 118 and the position of the balance balls 142. The angular position 158 of the load mass 118, relative to the vertical axis 112, represented by $(\alpha+\beta)$, and the position of the balance balls 142, relative to the vertical axis 112, represented by $(\alpha_{BB}+\beta_{BB})$, can be used to determine the mass phase difference 156 between the two positions relative to the vertical axis 112. During rotation of the drum 16 at low speeds, such as 50-100 rpm, for example, the balance balls 142 rotate slower relative to the load mass 118 such that the balance balls 142 move between in-phase and out of phase conditions, where the balance balls 142 are angularly adjacent to the load mass 118, or angularly opposite of the load mass 118, respectively. Thus, as the balance balls 118 rotate, they continuously move between −180° and 180° phase difference relative to the load mass 118. The phase difference 156 can be represented in the following equation:

$$\gamma=(\alpha+\beta)-(\alpha_{BB}+\beta_{BB}) \quad (2)$$

where $\gamma$=the phase difference between the laundry load and the balance balls, $(\alpha+\beta)$=the position of the load mass 118 relative to the vertical axis 112, and $(\alpha_{BB}+\beta_{BB})$=the position of the balance balls 142 relative to the vertical axis 112.

Utilizing parameter estimation, the values for the position of the load mass 118 and the balance balls 142 can be derived from equation (1) from the sensor measurements for the torque, acceleration, speed, and position of the drum 16. These values can be utilized in equation (2) to continuously determine the mass phase difference 156 between the load mass 118 and the balancing balls 142 in order to determine an optimal condition to ramp the rotation of the drum 16 from a low speed to a high speed. It has been determined that optimal time to ramp rotation from a low speed to a high speed is generally when the positions of the load mass 118 and the balance balls 142 are substantially opposite from one another in order to reduce tub-container contact during the ramping process. Additionally, ramping at the optimal time can facilitate entering high speed rotation in a balanced condition. Any suitable methodology or algorithm, proprietary or know, such as a recursive least squares algorithm can be used to estimate the parameters in such a model.

Figure 6:
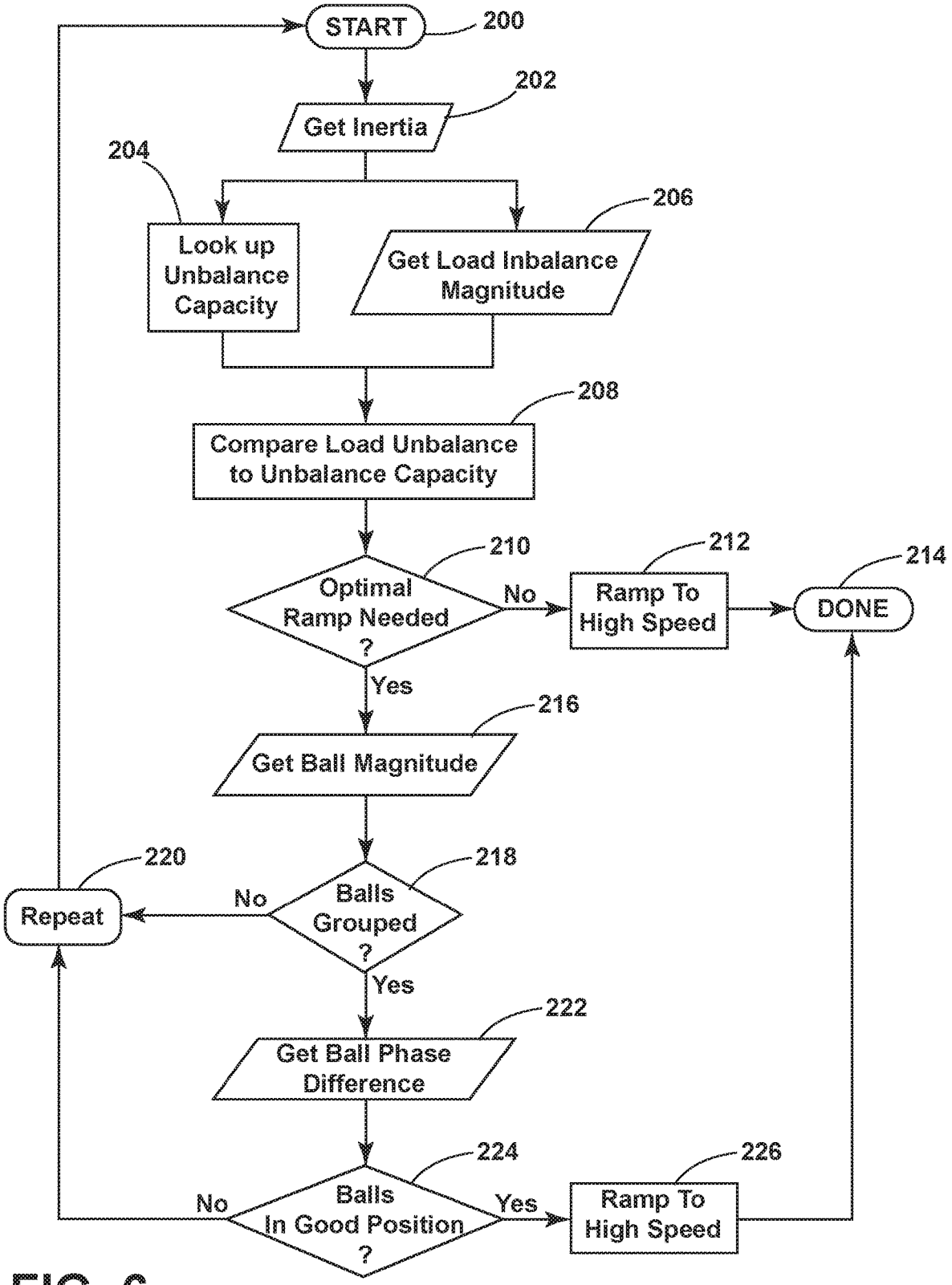
FIG. 6 is a decision chart illustrating a decision process for when to ramp the rotation of a drum from a low speed to a high speed based upon the phase difference of FIG. 5.

Referring now to FIG. 6, a decision chart for determining the optimal time to ramp the rotation speed of a laundry treating appliance from low speed to high speed is illustrated. The sequence depicted is for illustrative purposes only, and is not meant to limit the determination in any way, as it is understood that the determination can proceed in a different logical order or additional or intervening steps can be included without detracting from the invention. The determination can be implemented in any suitable manner, such as automatically or manually, as a stand-alone phase or cycle of operation or as a phase of an operation cycle of the washing machine 10. Further, the description of the determination is limited to the use of the terms magnitude, phase or position for ease of description.

At 200, the controller 88 can begin to rotate the drum 16 and accelerate the rotational speed of the drum 16 during an extraction cycle. More specifically, the controller 88 can cause the acceleration through operation of the motor 80. This can be done as part of an execution of the automatic cycle of operation. The drum 16 can be accelerated using any suitable initial low speed ramp. This can include, but is not limited to, accelerating the speed of the rotating laundry-container with a time-varying acceleration rate or at a fixed acceleration rate. For example, for a fixed acceleration rate, a fixed acceleration input to the motor 80, can be used to rotate the drum 16. By way of non-limiting example, the initial low speed ramp can include that the drum 16 is rotated from a non-satellizing speed to a satellizing speed. It is contemplated that the satellizing speed can be a predetermined speed or can be a speed at which the controller 88 determines the laundry can be satellized.

After the drum 16 is initially accelerated during the initial low speed ramp, the parameter estimator associated with the controller 88 can begin to monitor input values such as motor torque, speed, acceleration, or position of the drum. At 202, the parameter estimator can continuously estimate the inertia based upon the measured input values. After determining the inertia, the controller 88, at 204, can look up the imbalance capacity of the particular washing machine 10 and, at 206, utilize parameter estimation to determine the load imbalance magnitude within the drum 16. This load imbalance magnitude can comprise the position and magnitude of the load mass 118. The parameter estimator can provide a raw value of the load imbalance as a magnitude or position of the imbalance of the load mass 118, or both. Monitoring the load imbalance can include, but is not limited to estimating and monitoring the magnitude and position of the load mass 118.

At 208, the controller 88 can compare the imbalance capacity for the washing machine 10 to the load imbalance within the drum. At 210, the comparison made at 208 can be used to determine if the load imbalance is significant enough, relative to the imbalance capacity of the particular washing machine 10, to warrant an optimal ramp from low speed to high speed rotation. At 212, if the load imbalance is not significant enough to warrant an optimal ramp, the controller 88 can communicate to the motor 80 to ramp the rotation of the drum 16 to a high speed. At 214, after the high speed ramp is completed, the parameter estimation regarding the load imbalance can be completed.

Returning to 210, if an optimal ramp is determined to be needed based upon the load imbalance, at 216, the controller 88 can utilize parameter estimation to determine the magnitude of the center of mass of the balance balls 142. At 218, based upon the magnitude of the center of mass of the balance balls 142 and the known total mass of the balance balls 142, the controller 88 can determine if the balance balls 142 are appropriately grouped together, so as to provide a sufficient counterbalancing effect when angularly space from the load unbalance 118. During low speed rotation, the balance balls 142 can act somewhat randomly or chaotically, grouping together or spreading apart. As such, the balance ball magnitude can be utilized to determine if the balance balls 142 are appropriately grouped to determine a phase difference between the load mass 118 and the balance balls 142. At 220, if the balance balls 142 are not determined to be appropriately grouped, the controller 88 returns to the beginning of the decision chart and repeat the previous steps until it is determined that the balance balls 142 are appropriately grouped or that an optimal ramp is no longer needed.

At 222, if the balance balls 142 are determined to be appropriately grouped, the controller 88 can determine the balance ball phase difference from the load mass 118. Utilizing parameter estimation, the phase difference between the balance balls 142 and the load mass 118 can be estimated, as raw values, to determine if an optimal phase difference exists. An exemplary optimal phase difference can be between 160° and 180°. Additionally, the optimal phase difference can be variable, such that the washing machine 10 can be adapted to provide for a greater slip, or to compensate out-of-plane imbalances. It should be understood that the word slip can represent a variable angular range between the time of making the decision to ramp and actually needing the balance balls 142 to be opposite of the imbalance load mass 118 during ramping. For example, while the out of balance position of the balance balls 142 can have an optimal phase of 180°, the ramping process can be started at a phase difference of, for example, 165°, allowing for a 15° slip between an ramp time and reaching a critical rotation speed between 150-250 rpm, in the transition from low speed rotation to high speed rotation.

At 224, if the position of the balance balls 142 is determined to have an appropriate phase difference relative to the load mass 118, at 226, the controller 88 communicates to the motor 80 to ramp from the low speed to the high speed rotation, completing the parameter estimation sequence for determining an optimal ramp at 214.

It will be understood that the decision sequence of FIG. 6 can be flexible and is merely for illustrative purposes. For example, it is contemplated that if an undesirable phase is determined at 222, the controller 88 can continue to continuously estimate the phase difference between the balance balls 142 and the load mass 118 until a desirable phase difference is determined, without continuously returning to the start 200 of the decision chart.

Additionally, it is contemplated that at 218, the balance balls 142 can be largely ungrouped. The ungrouped orientation of the balance balls 142 can be advantageous in determining an optimal ramp condition. For example, an ungrouping of the balance balls 142 will have a small or negligible effect on the overall imbalance of the washing machine 10. As such, the need for the balance balls 142 to be out of phase with the load mass 118 can be unnecessary. Thus, the rotation of the drum 16 can ramp from a low speed to a high speed without the risk of contact resultant from the combined imbalance of the grouped balance balls 142 with the load mass 118.

Furthermore, the controller can use parameter estimation to periodically or continuously monitor the parameters of the washing machine model, represented by equation (1). Monitoring the parameters can include, but is not limited to estimating the magnitude and position of the load mass 118 and the magnitude and position of the balance balls 142. Monitoring the magnitudes and positions can include repeatedly determining the motor torque, speed, acceleration and position of the drum 16. It should be understood that as a part of the parameter estimation process, all parameters in equation (1) are continuously or periodically estimated, regardless of whether they are used directly in making any decision. This includes the inertia J, viscous friction b, coulomb friction c, load imbalance magnitude mgr and position β, balance ball magnitude $m_{BB}gr_{BB}$ and position $\beta_{BB}$. If monitoring the magnitudes and positions includes estimating the magnitudes and positions, then this can include repeatedly estimating the magnitudes and positions. Repeatedly determining the magnitudes and positions can include continuously, repeatedly estimating the magnitudes and positions.

Further, while the above description uses the term magnitude, it will be understood that the magnitude can include a raw value indicative of the mass of the object 118, 142, a gravitational acceleration, a radius from the longitudinal axis of the drum 16 to the center of the mass 120, 144, or a raw value indicative of the combination of the mass, gravitational acceleration, and the radius. Any of these values can be monitored and utilized in comparison to a prior measured value.

Further still, while the above description uses the term position, it will be understood that the position can include the rotational position of the drum 128, imbalance phase angle 130, balance ring arcuate angle 152, balance ball phase angle 154, or a value indicative of the combination of some or all of the values. Any of these can be monitored and utilized in the comparison to a prior measured value. This can be accomplished utilizing any suitable methodology or algorithm, proprietary or know, such as a recursive least squares algorithm used to estimate the parameters in such a model.

Figure 7:
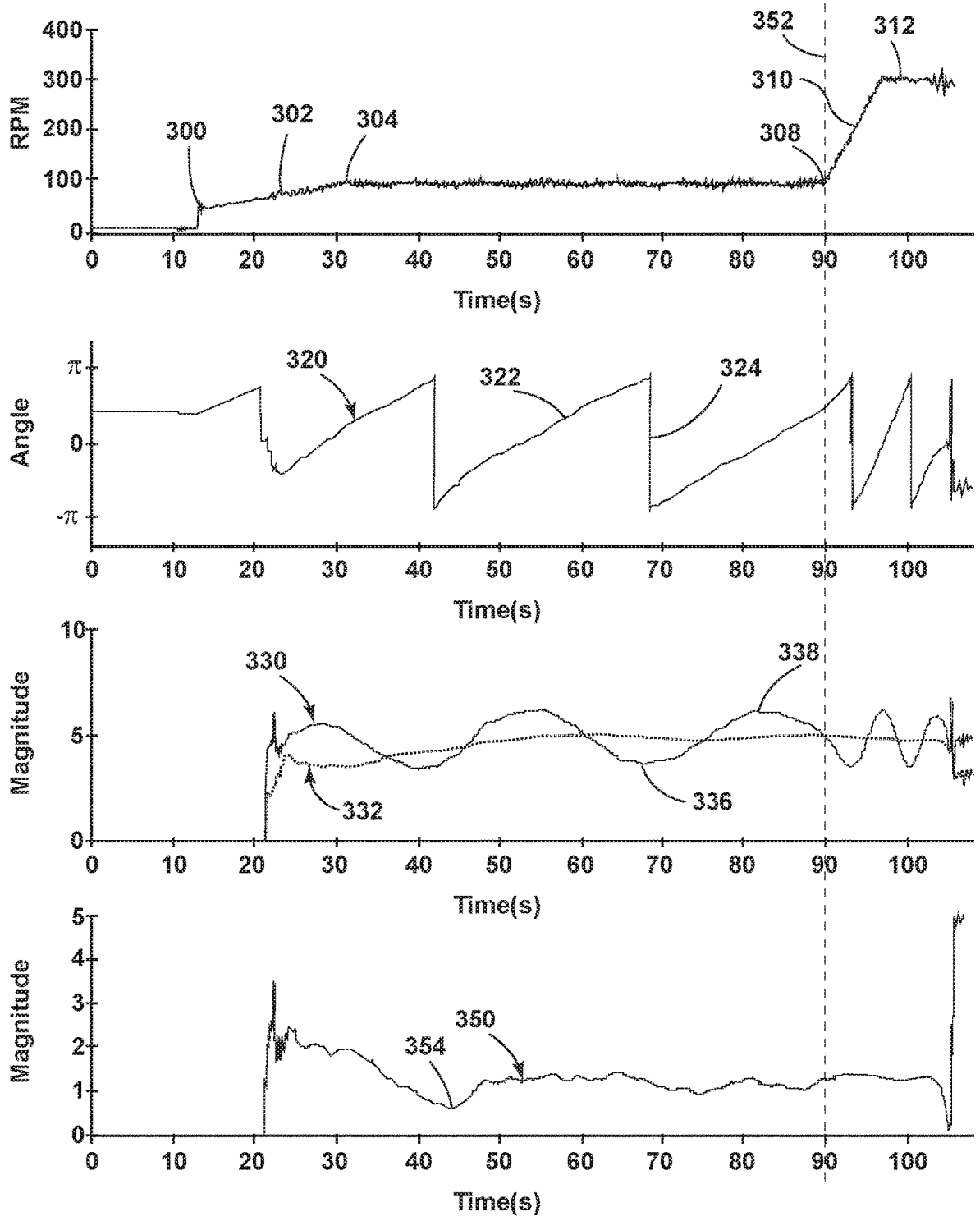
FIG. 7 is a series of four plots with a first plot illustrating the rotational speed of the drum over time, a second plot illustrating the phase difference between the laundry load and the balance balls over time, a third plot illustrating the laundry load imbalance and the total imbalance over time, and a fourth plot illustrating the ball imbalance over time.

FIG. 7 illustrates four exemplary plots. From top to bottom, the first plot illustrates the rotational speed of the drum 16 over time, the second plot illustrates the phase difference between the balance balls 142 and the load mass 118 over time, the third plot illustrates the magnitudes of the imbalance of the load mass 118 and the total imbalance over time, and the fourth plot illustrates the magnitude of the ball imbalance over time. Referring to the first plot, at 300, a liquid extraction cycle can begin and the drum rotation is accelerated. The motor 80 continuously accelerates the drum rotational speed at 302 until the desired low speed rotation is achieved. In the exemplary plot, the low speed rotation is approximately 90 rpm. The low rotation speed is held constant around the 90 rpm mark and acceleration becomes zero. The time under these conditions, shown from 300 to 304 is a distribution period and the time from 304 to 308, is an imbalance measurement period. During this period, the controller measures the torque of the motor, acceleration, speed, and angular position of the drum 16, which can be used to estimate the positions and magnitudes of the imbalance of the load mass 118 and the balance balls 142. At 308, the rotational acceleration ramps 310 the rotational velocity up to a high speed rotation, exemplarily shown as about 300 rpm at 312.

The second plot shows the phase difference 320, which is a representation of the mass phase difference 156 of FIG. 5, between balance balls 142 and the load mass 118. As can be appreciated, the phase difference 320 gradually increases at slope 322 from in phase when y=0 to out of phase when y=+/−π as the balancing balls 142, which rotate at a rate slightly less than that of the load mass 118, move from in-phase to out of phase. When y=0, the balance balls 142 and the load mass 118 are in-phase, such that their angular positions are adjacent to one another relative to a fixed axis. When y=+/−π, the balancing balls 142 and the load mass 118 are out of phase 324 such that their angular positions are opposite.

The third plot shows the magnitude of the total imbalance 330 and the load mass imbalance 332. As can be appreciated, the load mass imbalance 332 gradually develops an increase over time until it becomes relatively constant around an exemplary magnitude of five. The total imbalance 330 defines a generally sinusoidal curve. As such, the highest amplitude of the curve 338, relates to a greater imbalance magnitude when the balance balls 142 and the load mass 118 are in phase, and the lowest amplitude of the curve 336 relates to the least total imbalance magnitude when they are out of phase, as understood in comparison with the second plot.

The fourth plot shows the magnitude of the imbalance 350 of the balancing balls 142. The curve is somewhat chaotic, however settles around approximately a magnitude of 1.25. As the balancing balls 142 separate and abut one another during rotation, the magnitude of the imbalance of the balancing balls slightly varies over time.

As can be appreciated, an intersection line 352 intersects all four plots at the time when optimal conditions exist to ramp from low speed rotation to high speed rotation. The first plot shows that the rotation will be kept at a low speed rotation during the measurement period, where a parameter estimator can continuously monitor the washing machine 10 until optimal conditions exist. The exemplary optimal phase difference, in the second plot, is approximately 160° approaching an out of phase condition. It should be appreciated that particular conditions of the washing machine 10 can determine when the optimal phase difference exists on a per-appliance basis, and can be from 150°-180° either approaching or returning from an out of phase condition. Additional exemplary optimal ramp times can be when the total magnitude is at a minimum or approaching a minimum. Alternatively, in an example where there is a load imbalance offset from the planar with a vertical position of a single balance ring, it may not be optimal to ramp when the balance balls are near opposite or opposite in angle or phase, which can change the optimal phase difference such that 150°-180° is not optimal and some other phase difference is optimal. Finally, in the fourth plot, the imbalance magnitude of the balance balls can be within a general range, shown as about a magnitude of 1.25, such that a ramp to a high speed is not initiated when the balancing balls are spread out, as can be the case at 354.

As such, it should be appreciated the during the time as a constant low speed rotation of the drum 16, the torque, speed, acceleration, and position of the drum 16 can be utilized with parameter estimation to determine an appropriate phase difference between the balancing balls 142 and the load mass 118, an optimal total imbalance 330, and an optimal balancing ball magnitude 350 in order to determine the optimal time to ramp from a low speed to a high speed rotation of the drum 16.

Utilizing the aforementioned method and apparatus, an optimal time can be calculated to perform a ramp from a low speed rotation to a high speed rotation during an extraction phase of a laundry treating cycle in order to avoid tub-container contact. As such, the above-described embodiments provide a variety of benefits including that potential damage to the laundry treating appliance can be reduced and lifetime can be increased. Additionally, treating capacity can be increased by permitting the use of a larger drum such that the gap between the drum and the tub can be decreased without the need to increase the size of the laundry treating appliance itself.

Additionally, it should be appreciated that the aforementioned method and apparatus within a horizontal axis washing machine is exemplary, and use within alternative appliances are contemplated. The method and apparatus can alternatively be utilized in additional laundry treating appliances such as a vertical axis washing machine, a combination washing machine and dryer, a tumbling refreshing/revitalizing machine, an extractor, and a non-aqueous washing apparatus, in non-limiting examples.

The above-described embodiments are more accurate and precise as compared to the existing solution, as the determination is driven directly by the optimal conditions for ramping to high speed liquid extraction. Furthermore, the above-described embodiments offer a solution that continuously provides information about the position and magnitude of imbalance masses, rather than relying on an extrapolation, which fails to capture the true behavior of the washing machine.

To the extent not already described, the different features and structures of the various embodiments can be used in combination with each other as desired. That one feature is not illustrated in all of the embodiments is not meant to be construed that it cannot be, but is done for brevity of description. Thus, the various features of the different embodiments can be mixed and matched as desired to form new embodiments, whether or not the new embodiments are expressly described. All combinations or permutations of features described herein are covered by this disclosure.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of operating a laundry treating appliance having a drum at least partially defining a treating chamber for receiving a laundry load for treatment according to a cycle of operation, a motor operably coupled with the drum to rotate the drum, and at least one balance ring mounted to the drum and defining an internal annular cavity in which a mass is located, the method comprising:

rotating the drum during a measurement period;

determining, during the measurement period, by a controller communicably coupled with the motor, at least one of a torque of the motor, an acceleration of the drum, a speed of the drum, and an angular position of the drum;

repeatedly estimating with a parameter estimator, during the measurement period, a relative position of an imbalance of a laundry load and a relative position of the mass, based on at least one of the torque, acceleration, speed, and angular position of the drum; and accelerating the rotating of the drum during the cycle of operation when the relative position of the mass is determined to be angularly spaced from the relative position of the imbalance of the laundry load.

2. The method of claim 1 further determining a reference position for the mass, relative to the angular position of the drum.

3. The method of claim 1 wherein determining a relative position of the mass comprises repeatedly determining the position of the mass with a sensor.

4. The method of claim 3 wherein the parameter estimator can repeatedly estimate the relative position of the mass and the relative position of the imbalance of the laundry load utilizing a first model comprising:

$$T=J\dot{\omega}+b\omega+c+mgr\sin(\alpha+\beta)+m_{BB}gr_{BB}\sin(\alpha_{BB}+\beta_{BB})$$

wherein T=torque, J=inertia, $\dot{\omega}$=acceleration of the drum, ω=rotational speed of the drum, b=viscous friction, c=coulomb friction, m=mass of the imbalance of the laundry load, g=gravitational acceleration, r=radius from an axial center of the drum to a center of mass of the imbalance of the laundry load, α=rotational position of the drum, β=rotational position of the imbalance of the laundry load relative to the rotational position of the drum, $M_{BB}$=mass of the center of mass of the mass, $r_{BB}$=radius from the center point of the drum to the center of mass of the mass, $\alpha_{BB}$=rotational position reference for the mass, and $\beta_{BB}$=rotational position of the center of mass of the mass relative to the rotational reference position $\alpha_{BB}$.

5. The method of claim 4 further comprising determining the angular spacing of the relative position of the mass and the relative position of the imbalance of the laundry load utilizing a second model comprising:

$$\gamma=(\alpha+\beta)-(\alpha_{BB}+\beta_{BB})$$

wherein γ=the angular spacing, α=rotational position of the drum, β=rotational position of the imbalance of the laundry load relative to the rotational position of the drum, $\alpha_{BB}$=rotational position reference for the mass, and $\beta_{BB}$=rotational position of the center of mass of the mass relative to the rotational reference position $\alpha_{BB}$.

6. The method of claim 1 further comprising repeatedly estimating with a parameter estimator, during the measurement period, a magnitude of the mass and a magnitude of the imbalance of the laundry load, based on at least one of the torque, acceleration, speed, and angular position of the drum.

7. The method of claim 1 wherein the mass is a plurality of balance balls.

8. The method of claim 7 further comprising:

determining that the plurality of the balance balls are ungrouped about the internal annular cavity; and accelerating the rotating of the drum in response to the determination that the plurality of balance balls are ungrouped without regard to the angular spacing, such that the angular spacing of the relative position of the ungrouped balance balls is indeterminable relative to the position of the imbalance of the laundry load.

9. The method of claim 1 wherein the parameter estimator is operated continuously throughout the measurement period.

10. The method of claim 9 wherein the acceleration or deceleration of the drum during the measurement period is about zero.

11. The method of claim 1 wherein the relative position of the mass is a raw value.

12. The method of claim 11 wherein the relative position of the imbalance of laundry load is a raw value.

13. The method of claim 1 wherein the at least one balancing ring comprises two balance rings.

* * * * *